US009047757B2

(12) United States Patent
Swaminathan et al.

(10) Patent No.: US 9,047,757 B2
(45) Date of Patent: Jun. 2, 2015

(54) SYSTEMS AND METHODS FOR REMOTELY CONTROLLING AN ADVANCED METERING INFRASTRUCTURE

(71) Applicant: Florida Power & Light Company, Juno Beach, FL (US)

(72) Inventors: Radhakrishnan Swaminathan, Jupiter, FL (US); Paul J. Ollukaren, Palm Beach Gardens, FL (US); Susan Lynn King, Stuart, FL (US); Anuja Nakkana, Palm Beach Gardens, FL (US); James Ray Bouchillon, Lake Worth, FL (US)

(73) Assignee: FLORIDA POWER & LIGHT COMPANY, Juno Beach, FL (US)

( * ) Notice: Subject to any disclaimer, the term of this patent is extended or adjusted under 35 U.S.C. 154(b) by 205 days.

(21) Appl. No.: 13/676,667

(22) Filed: Nov. 14, 2012

(65) Prior Publication Data

US 2013/0120156 A1 May 16, 2013

Related U.S. Application Data

(60) Provisional application No. 61/559,429, filed on Nov. 14, 2011.

(51) Int. Cl.

| | |
|---|---|
| ***G08B 23/00*** | (2006.01) |
| ***G08C 15/06*** | (2006.01) |
| ***G08C 19/00*** | (2006.01) |

(52) U.S. Cl.

CPC ..... *G08C 19/00* (2013.01); *G08C 2201/42* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,509,841 | B1 * | 1/2003 | Colton et al. | 340/870.11 |
| 6,751,562 | B1 * | 6/2004 | Blackett et al. | 702/61 |
| 7,734,380 | B2 * | 6/2010 | Ransom et al. | 700/286 |
| 2008/0074284 | A1 * | 3/2008 | Edwards et al. | 340/870.02 |
| 2008/0219239 | A1 * | 9/2008 | Bell et al. | 370/351 |
| 2010/0293045 | A1 * | 11/2010 | Burns et al. | 705/14.11 |
| 2011/0035510 | A1 * | 2/2011 | Alexander | 709/246 |
| 2013/0145452 | A1 * | 6/2013 | Ollukaren et al. | 726/15 |

* cited by examiner

*Primary Examiner* — Travis Hunnings
(74) *Attorney, Agent, or Firm* — Feldman Gale, PA; Rafael Perez-Piñeiro

(57) ABSTRACT

A computer-implemented method for remotely controlling an AMI is disclosed. The method includes receiving at an AMI controller module, meter event data from a remote command and control module; generating, at a third module, rules for the management, implementation and compliance documentation of connect/disconnect orders; processing, at the third module, the meter event data based on those rules to aggregate, batch, filter, or prioritize execution of individual connect/disconnect orders; communicating the connect/disconnect execution orders and policy compliance verification information to the AMI controller module; and, at the AMI controller module, executing connect/disconnect operations via the command and control module.

19 Claims, 5 Drawing Sheets

SYSTEMS AND METHODS FOR REMOTELY CONTROLLING AN ADVANCED METERING INFRASTRUCTURE

FIELD OF THE INVENTION

Embodiments of the present invention generally relate to transmission of power to an end user, and more particularly to advanced metering infrastructure (AMI) used in electricity meters, gas meters, water meters and the like.

BACKGROUND OF THE INVENTION

Electricity generated at a power station may be produced using a plurality of energy sources, such as coal powered power stations, nuclear fission, hydroelectric stations, wind farms, solar photovoltaic cells, etc. This power generated at the power station is transmitted to users over a transmission grid. In recent years advancements have been made in transmission of power to an end user. One such advancement has been in the area of electrical power meters.

An electrical power meter may be implemented as an automatic meter reader (AMR) where the electricity usage is communicated one way to a meter reader. More recently, AMI meters have been developed. AMI meters differ from traditional AMRs in that they enable two-way communications between meters and an AMI command and control system. AMI command and control system may receive data from the AMI meter and communicate it over a network to remote locations. Also, AMI command and control systems may send data to electric meters to perform various tasks.

Automated meter reading (AMR) or AMI may often be configured to transmit data relating to utility usage parameters to a remote location, such as a utility company. However, many AMR devices are functionally limited in their communications options and may not be adaptable to communications technology.

The use of AMI has been limited to suppliers, utility companies and service providers. However, a need exists for providing utility companies with remote tools to utilize the potential of AMI. Additionally, users of AMR/AMI devices may need technologies for monitoring and controlling the AMR/AMI devices remotely. In a large network of AMR devices, costs associated with each connection/disconnection can be costly and inefficient.

SUMMARY

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

A utility remote control system for rules-based management and documentation of connection and disconnection (C/D) operations is disclosed. The system may include: (i) a business application that communicates with numerous software applications, including interactive voice response (IVR) modules, applications to process customer requests entered through the web site of a utility, and demand side management applications; and (ii) an AMI controller that communicates with the business application and a remote control module.

The business application provides a rule engine for the management, implementation and compliance documentation of C/D orders. The rules may be based on various business drivers, including for example, revenue, write-off risk, customer perception, and political sensitivity. Rules also provide C/D order execution security. For example, rules can limit access to C/D control of utilities for sensitive areas, such as hospitals.

Based on the rules, the business application aggregates, batches, filters, and prioritizes execution of individual C/D orders. Thereafter, the business application communicates with the AMI Controller to complete execution of C/D orders so as to minimize impacts to utility services, such as call centers. The management and execution of the C/D orders is documented for later audit and policy-compliance purposes. In addition, the business application provides a real-time analysis of C/D orders for the assessment of operational effectiveness.

The AMI controller securely receives C/D orders along with policy compliance verification information from the business application. The AMI controller executes C/D operations via an AMI meter remote control module, and documents policy compliance information for diligence purposes. The AMI Controller also receives field initiated event information from the AMI meter remote control module and communicates it to the controller. The AMI Controller also provides a platform for operational control of multiple meters based on field conditions such as storm, electric network, and cyber- security events.

These features and advantages of the present invention will become more readily apparent from the attached drawings and description of illustrative embodiments, which follow.

BRIEF DESCRIPTION OF THE DRAWINGS

The drawings, in which like numerals represent similar parts, illustrate generally, by way of example, but not by way of limitation, various embodiments discussed in the present document.

DETAILED DESCRIPTION OF ILLUSTRATIVE EMBODIMENTS

The following detailed description of certain embodiments of the subject matter set forth herein, will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

In the following detailed description, reference is made to the accompanying drawings which form a part hereof, and in which are shown by way of illustration specific embodiments in which the subject matter disclosed herein may be practiced. These embodiments, which are also referred to herein as "examples," are described in sufficient detail to enable those skilled in the art to practice the subject matter disclosed herein. It is to be understood that the embodiments may be combined or that other embodiments may be utilized, and that structural, logical, and electrical variations may be made without departing from the scope of the subject matter disclosed herein. The following detailed description is, therefore, not to be taken in a limiting sense, and the scope of the subject matter disclosed herein is defined by the appended claims and their equivalents. In the description that follows, like numerals or reference designators will be used to refer to like parts or elements throughout.

Figure 1:
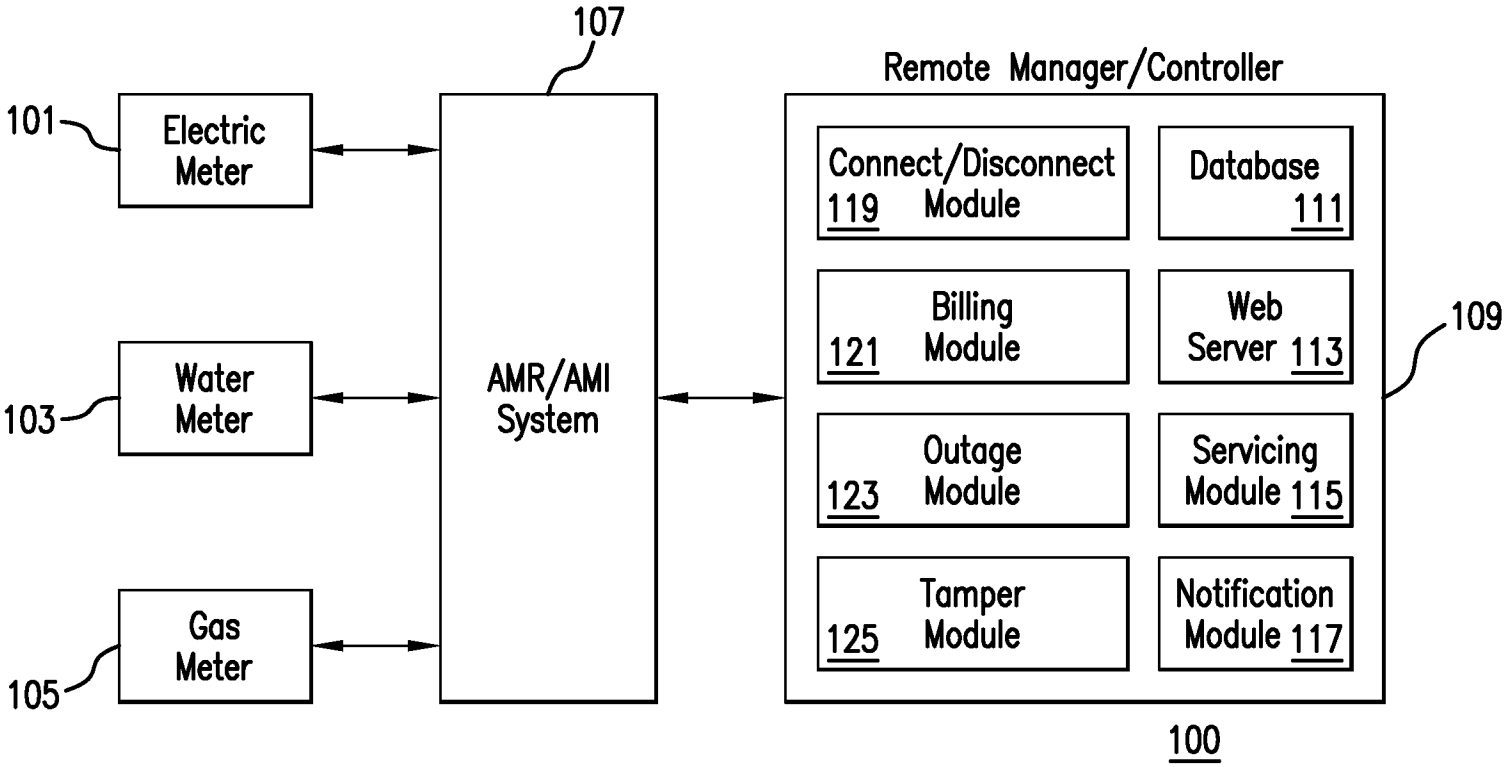
FIG. 1 illustrates a block diagram of a remote management and controller system in accordance with an embodiment.

FIG. 1 illustrates a block diagram of a remote management and controller system in accordance with an embodiment. In one embodiment of the subject matter disclosed herein systems and methods for remotely controlling an advanced metering infrastructure is provided. Each meter 103, 105, 107 on the network may communicate and receive data from a remote management and control module 109 and the AMR/AMI system 107. Furthermore, the AMR/AMI meter device may receive command and control functions from the utility via the same communications network, and may relay those functions to other AMI devices associated with that particular host AMI device.

Optionally, the system may include a user interface, such as a graphical user interface (GUI), to allow users and the utility to monitor and communicate with AMI devices over a network through a web server module 113, for example. For example the network may be a wired or a wireless network. According to one embodiment, the interface may enable utility companies to communicate directly with the AMR/AMI. Optionally, the interface may enable utility companies to communicate with meters via the AMR/AMI. The interface may also accept instructions by utility companies to be sent to the meters. The instructions may be one of, but not limited to connect or disconnect supply, outage monitoring, tamper monitoring, meter servicing and the like. These instructions may be processed through use of a C/D module 119, an outage module 123, a tamper module 125, and a servicing module 115.

In an alternate embodiment, a notification module 117 may be configured to send alerts and other communication to the personnel approved by a utility company to receive such communication. For example, the system may transmit a signal to a pager, notifying a technician of a power outage at the monitored electric meter. For example, the system may send an RF transmission to a billing system, notifying the billing system to temporarily suspend billing a customer's account (account information may be stored in Customer Information System (CIS) module 223 or 233 in FIG. 2) until such time as the electric meter is repaired. The billing system may be implemented as a billing module 121. The data collected by the AMI system 107 and records of the transactions discussed above may be stored in a database 111.

Figure 2:
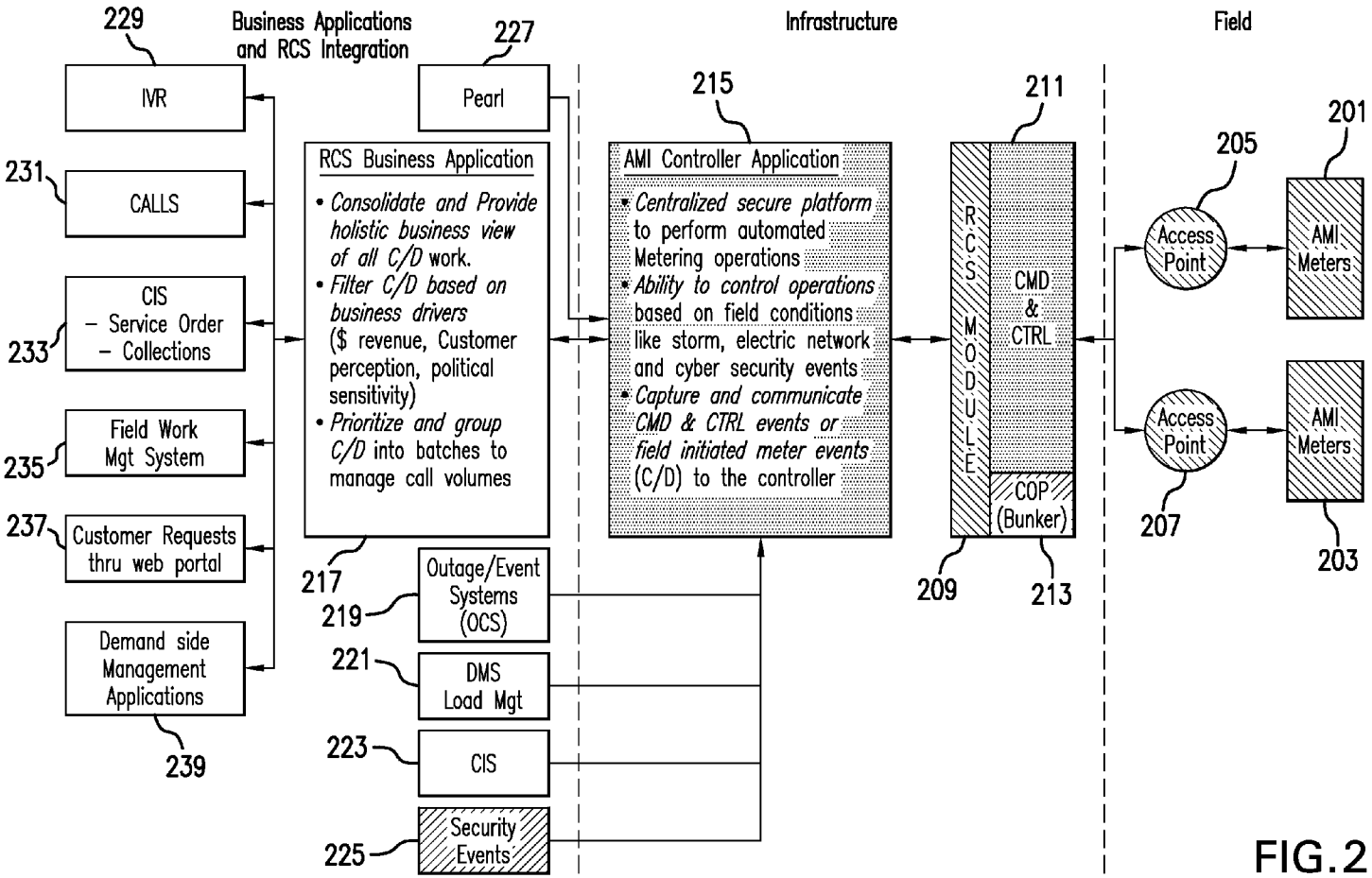
FIG. 2 illustrates application components for a remote AMR/AMI manager/controller in accordance with one embodiment.

FIG. 2 illustrates application components for the remote AMR/AMI manager/controller. The system, in one embodiment, may be a rules-based management system. For example, the system may be used for connection and disconnection (C/D) operations. The system may optionally provide documentation of all operations performed by the system. For example, the documentation may be stored in a database within the remote manager/controller system. Optionally, the database may be at yet another location which is at a different location from the system. In one embodiment, the database may be a simple file system stored in memory, or an xml based documentation or a database such as MySQL, MSSQL, Oracle and the like. For example, the documentation may be done for connection and disconnection (C/D) operations.

The system of FIG. 2 may include smart meters 201 and 203; access points 205 and 207; a command and control module 211; an AMI Controller Application 215; a Remote Connect Service (RCS) Business Application 217; a PEARL module 227; Outage/Event Systems module 219; DMS Load Management module 221; Customer Information System (CIS) module 223; Security Events module 225; an interactive voice response (IVR) module 229; a Calls module 231; a CIS Service Order and Collections Module 233; a Field Work Management System module 235; Customer Requests Via Web Portal module 237; and Demand-Side Management Applications module 239. PEARL 227 may be defined as an application used by customer care to receive calls from customers who have trouble with the utility services. The Outage/Event system module 219 may present a unified view of power problems throughout various channels, such as maps, interactive voice response (IVR), outgoing calls, etc. CIS module 223 keeps track of customer accounts and their statuses. CIS module 233 keeps track of service orders and bill collections related to the customer.

The smart meters 201 and 203 may include a two-way communications interface that allows the transmission of events to the AMI wirelessly through Access Points 205 and 207. In turn, Access Points 205 and 207 may connect to the meters to a wireless mesh connection, for example, and relay the event information and other meter data to the AMI by use of a cellular communications channel.

In one embodiment, the command and control module 211 may implement a number of functions. For example, the module 211 may run a meter manager application that automates the process of collecting meter data by enabling continuous connectivity with meters, which in turn enables the AMI to improve energy efficiency, increase the accuracy of the utility's customer billing, support remote disconnect and reconnect services, and improve outage detection and isolation. The module 211 may run an application that provides alerts about meter locations where voltage levels drop below preset thresholds. The module 211 may also run an outage detection application to ascertain the time, type, and location of outages.

The system may include a business application 217 that communicates with numerous software applications, including interactive voice response (IVR) modules 229, applications to process customer requests entered through the a web portal 237, and demand side management applications 239. The system may include a remote AMI controller application 215 that communicates with the business application 217 and a remote command and control and module 211.

In one embodiment, the business application 217 may provide a single business rule engine between the remote AMI controller application 215 and back office applications 229-239, minimizing changes to those applications. Optionally, the business application 217 may prioritize C/D orders based on business drivers. For example, such drivers may include write-off risk, impact to call center, time of day, or the like or any combination thereof. In addition, the business application 217 may minimize unknown kilowatt usage (UKU), thus minimizing lost revenues. Furthermore, the remote AMI controller application 215 may provide reports and dashboards to monitor the effectiveness of the operation in its entirety or in part.

In one embodiment, the business application 217 may provide a rule engine for the management, implementation and compliance documentation of C/D orders. The rules may be based on various business drivers, including but not limited to, for example, revenue, write-off risk, customer perception, and political sensitivity. In another embodiment the rules may also provide C/D order execution security. For example, rules can limit access to C/D control of utilities for sensitive areas, such as hospitals. For example, the system of the present invention provides security and traceability for all C/D operations. In addition, the remote disconnect operations provide added security as utility personnel would not be exposed to the risk of confronting customers attempting to impede disconnection. Further, the prioritized reconnection process enabled by the present invention takes into account instantaneous load limitations of a utility. Still further, the prioritized or programmed disconnection of service can be scheduled such that customer service does not receive a large number of calls at once. Optionally, remote AMI controller application 215 may manage global business rules providing a mechanism to stop all processing in the event of a cyber threat.

In one embodiment of the subject matter disclosed herein the rules may be created to execute orders. For example based on the rules, the business application 217 aggregates, batches, filters, and prioritizes execution of individual C/D orders 233. The business application may further communicate with the remote AMI controller application 215 to complete execution of C/D orders so as to minimize impacts to utility services, such as call centers 231. AMI controller application 215 splits the orders further into a sequence of operations submitted to the AMI command and control module 211 which completes the orders. The management and execution of the C/D orders may be documented for audit and policy-compliance purposes. Additionally, the business application 217 may provide a real-time analysis of C/D orders for the assessment of operational effectiveness.

In another embodiment of the subject matter disclosed herein, the remote AMI controller application module 215 may receive instructions over a secured network. The instructions may be sent along with policy compliance verification information from the business application 217. The remote AMI controller application module 215 may execute C/D operations via an AMI meter remote control module (a service of the command and control module 211), and documents policy compliance information for diligence purposes. The remote AMI controller application module 215 may also receive field initiated event information from the meters 201 and 203. The remote AMI controller application module 215 may process the event information and communicate it to the utility company. The remote AMI controller application module 215 may also provide a platform for operational control of multiple meters based on field conditions such as storm, electric network, and cyber-security events.

The remote AMI controller application module 215 may reduce or eliminate a need for on-site visits by utility company. Additionally, the remote AMR/AMI manager/controller may help the utility companies meet the documents compliance standards required by government agencies. Moreover, a utility company may have internal requirements for document collection, and such requirements may also be accomplished by the remote AMI controller application module 215.

Furthermore, the remote AMI controller application module 215 may also help provide new regulatory policies, C/D security, limit impacts of C/D operations on other services, and automate the C/D functionality based on probabilistic, as opposed to deterministic operation. In one embodiment, these systems include hardware, software, communications, consumer energy displays and controllers, customer associated systems, Meter Data Management (MDM) software, supplier business systems, and the like. In one embodiment, the system may be hardware based, or software based, or any combination thereof.

The CIS service order and collections module 233 creates work orders to go to the customer premises to change meters or associated components that affect electric service in order to collect any pending bill payments. Field Work management system 235 picks up all orders in CIS 233 that require personnel to go to customer premises and sends it to appropriate applications.

PEARL (Power Equipment and Reliability Liaison) 227 is a customer care applications which care center personnel use when customer calls are received due to power problems. Outage/ event system or outage communication system (OCS) 219 presents a unified view of a utility's power outages and estimated time to restore (ETR) through multiple channels, such as, interactive maps, interactive voice response (IVR), web site, outgoing calls, etc.

Distribution Management System (DMS) 221 provides tracking of the electrical network when feeder lines are switched from their normally operating positions due to various reasons. The Customer Information System (CIS) 223 maintains the records of customers, accounts, bills and payments, their service location and status.

Security Events 225 represents the information from other cyber threat response system manually input into the controller application module 215. In an alternative embodiment, some of the functionality of the business application 217 may be migrated to the command and control module 211.

Critical Operations Protector (COP) 213 is a commercially available product that limits the rates of connecting and disconnecting meters to change the electric service of the premises. It does so by issuing permits that are required by the firmware on the meter to execute such critical operations. If the number of operations exceeds the predefined hourly or daily limits, permits are not issued. This feature protects the bulk electric grid from having big changes to power usage.

Figure 3:
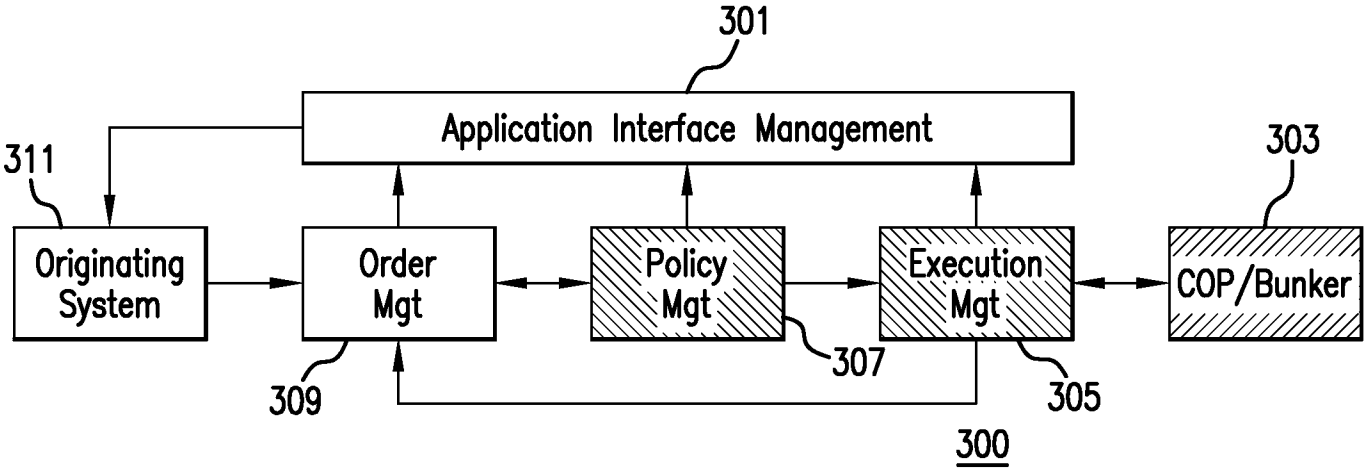
FIG. 3 illustrates a process for application interface management in accordance with an embodiment.

FIG. 3 illustrates a process for application interface management flow 301 in accordance with an embodiment. The originating system generates C/D orders and C/D policies that are processed by an Order Management Module 309 and a Policy Management Module 307. The Execution Management Module 309 sends execution of C/D orders through the COP/Bunker Module 393 based on the particular orders and the policies received from modules 307 and 309 to be executed on the meters.

Figure 4:
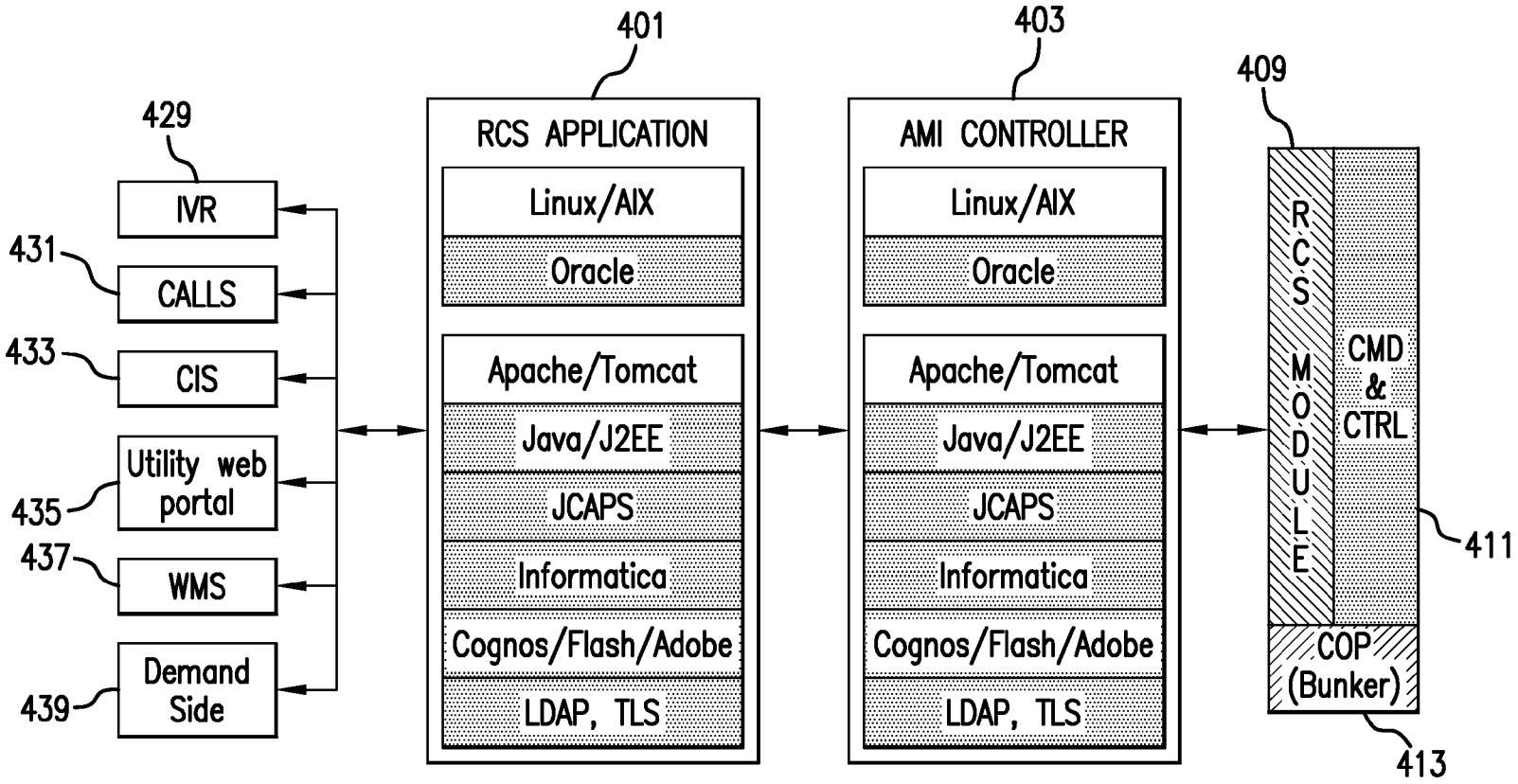
FIG. 4 illustrates a technology architecture for a remote management and controller system in accordance with an embodiment.

FIG. 4 illustrates a technology architecture for a remote management and controller system in accordance with an embodiment. The business application 401 and the AMI controller application 403 may have a similar software stack in accordance with one embodiment. The two comprise the interface between the front end system 411 and the backend modules 429-439.

In one embodiment the software stack may include an Apache/Tomcat module to implement a web server that provides a Java HTTP web server environment for Java code to run and that allows access to applications in the software stack through an Internet connection. The Apache Tomcat may include tools for configuration and management and can also be configured by editing XML configuration files.

The software stack may also include a Java/J2EE module to simplify application development in a thin client tiered environment. The J2EE may simplify application development by creating standardized, reusable modular components and by enabling the tier to handle many aspects of programming automatically.

The software stack may also include a JCAPS module which may be used to develop software infrastructure in a service-oriented architecture. In one embodiment, JCAPS may be used to deliver new business services in a SOA environment.

The software stack may also include Informatica, a software tool to move large amounts of data between application data stores. In one embodiment, master data related to customers, premises and accounts may be stored in the application from other source systems such as a data warehouse.

The software stack may also include a Cognos/Flash/Adobe module for generation of business intelligence reports based on policies. In one embodiment, this module may be used as the rules engine.

The software stack may also include a LDAP/TLS module that can be used for authentication purposes, including access and maintenance of distributed directory information services over an Internet Protocol (IP) network such as the Internet.

Figure 5:
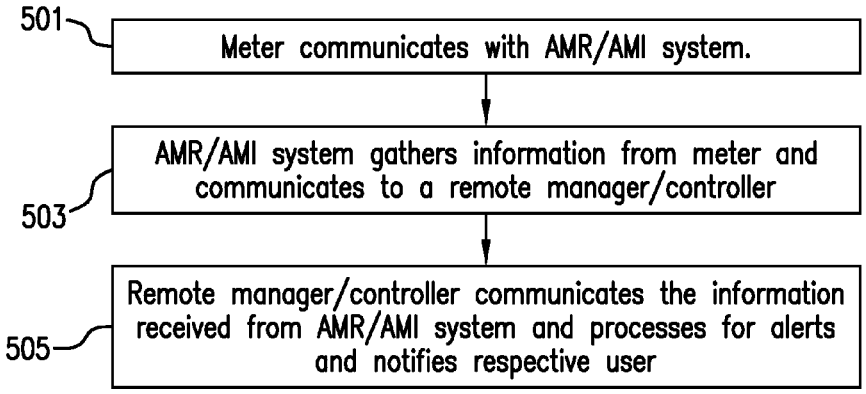
FIG. 5 illustrates a process of communication between a meter and remote management and controller system in accordance with an embodiment.

FIG. 5 illustrates a process of communication between a meter and remote management and controller system in accordance with an embodiment. At step 501 a meter communicates with the AMR/AMI command and control system. At step 503 the AMR/AMI command and control system gathers information from the meter and communicates the information to a remote AMI controller application. At step 503, the remote AMI manager/controller communicates the information received from AMR/AMI system and processes the information to generate, alerts, etc. and notifies a user of the AMI application.

Figure 6:
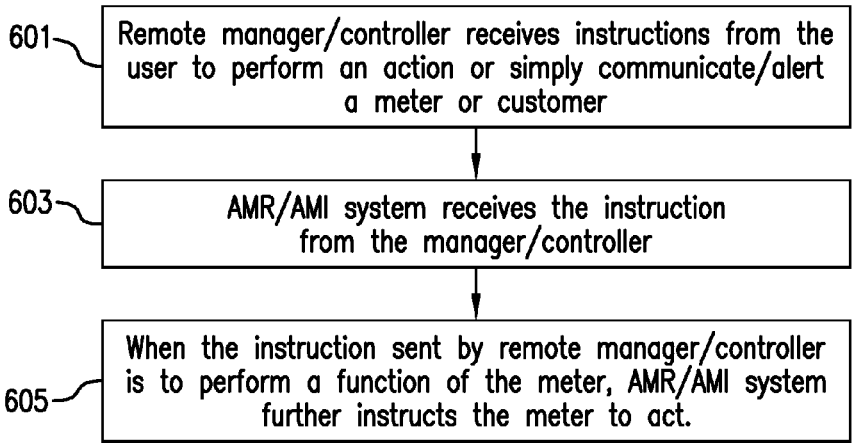
FIG. 6 illustrates a process for performing management and control function using the remote management and controller system in accordance with one embodiment.

FIG. 6 illustrates a process for performing management and control function using the remote management and controller system. At step 601 a remote AMI controller application receives instructions from the user to perform an action or simply communicate with or send an alert or commands to a meter, customer, or customer device. A step 603 the AMR/AMI command and control system receives the instructions from the AMI controller. At step 605, when the instruction sent by remote AMI controller application is to perform a function of the meter, the AMR/AMI command and control system further instructs the meter to perform the function (e.g., a C/D operation).

In one embodiment of the subject matter described herein the customer may have a plurality of sources of electricity, to power the customer's home/office. For example, the plurality of sources may include solar power, bio-gas plant, gas power turbines, and the like. The plurality of sources may be customer owned, or the electricity may be provided by a utility company, or any combination thereof.

In one embodiment of the subject matter described herein the utility company may have a plurality of sources of electricity, to power the customer's home/office. For example, the plurality of sources may include solar power, bio-gas plant, gas power turbines, and the like. The plurality of sources may be customer owned, government/corporation owned, or the electricity may be provided by a utility company, or any combination thereof.

The various embodiments and/or components, for example, the modules, elements, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as an optical disk drive, solid state disk drive (e.g., flash RAM), and the like. The storage device may also be other similar means for loading computer programs or other instructions into the computer or processor.

As used herein, the term "computer" or "module" may include any processor-based or microprocessor-based system including systems using microcontrollers, reduced instruction set computers (RISC), application specific integrated circuits (ASICs), field-programmable gate arrays (FPGAs), graphical processing units (GPUs), logic circuits, and any other circuit or processor capable of executing the functions described herein. The above examples are exemplary only, and are thus not intended to limit in any way the definition and/or meaning of the term "computer."

The computer or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer or processor as a processing machine to perform specific operations such as the methods and processes of the various embodiments of the invention. The set of instructions may be in the form of a software program, which may form part of a tangible non-transitory computer readable medium or media. The software may be in various forms such as system software or application software. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software", "firmware" and "algorithm" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, types of materials and coatings described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A computer-implemented method for remotely controlling an AMI, comprising:

receiving at an AMI controller module, meter event data from a remote command and control module;

generating, at a third module, rules for the management, implementation and compliance documentation of connect/disconnect orders;

processing, at said third module, the meter event data based on said rules to aggregate, batch, filter, or prioritize execution of individual connect/disconnect orders;

communicating said connect/disconnect execution orders and policy compliance verification information to said AMI controller module; and at the AMI controller module, executing connect/disconnect operations via said command and control module.

2. The method of claim 1, wherein the rules provide connect/disconnect order execution security, including limiting access by the command and control module to connect/disconnect utilities for sensitive areas.

3. The method of claim 1, wherein the third module provides a real-time analysis of connect/disconnect orders for the assessment of operational effectiveness.

4. The method of claim 1, further comprising a step of documenting management and execution of the connect/disconnect orders for subsequent auditing and policy compliance assessment.

5. The method of claim 1, wherein the AMI controller module documents policy compliance information for diligence purposes.

6. The method of claim 1, wherein the AMI controller provides operational control of multiple meters.

7. The method of claim 1, further comprising providing, at said AMI controller module, an interface to at least one of:

an outage module, a load management module, a customer information system module, and a security events module.

8. The method of claim 1, further comprising providing, at said third module, an interface to at least one of:

an IVR module, a call center module, a customer information system module, a field management system, a customer request web portal, and a demand side management application.

9. The method of claim 1, wherein said events include at least one of outage data, consumer energy consumption, weather data, or meter malfunction data.

10. The method of claim 1, wherein said rules are based on at least one of utility revenue, write-off risk, customer perception, and political sensitivity.

11. A system for remotely controlling an advanced metering infrastructure, the system comprising:

a remote command and control module;

an AMI controller module configured to receive meter event data from said remote command and control module, receive connect/disconnect execution orders and policy compliance verification information, and executing connect/disconnect operations via said command and control module; and a third module configured to generate rules for the management, implementation and compliance documentation of connect/disconnect order, and process the meter event data based on said rules to aggregate, batch, filter, or prioritize execution of individual connect/disconnect orders.

12. The system of claim 11, wherein the rules provide connect/disconnect order execution security, including limiting access by the command and control module to connect/disconnect utilities for sensitive areas.

13. The system of claim 11, wherein said third module is further configured to provide a real-time analysis of connect/disconnect orders for the assessment of operational effectiveness.

14. The system of claim 11, wherein said AMI controller module is further configured to document policy compliance information for diligence purposes.

15. The system of claim 11, wherein said AMI controller is further configured to provide operational control of multiple meters.

16. The system of claim 11, wherein said AMI controller module is further configured to provide an interface to at least one of:

an outage module, a load management module, a customer information system module, and a security events module.

17. The system of claim 11, wherein said third module is further configured to provide an interface to at least one of:

an IVR module, a call center module, a customer information system module, a field management system, a customer request web portal, and a demand side management application.

18. The system of claim 11, wherein said events include at least one of outage data, consumer energy consumption, weather data, or meter malfunction data.

19. The system of claim 11, wherein said rules are based on at least one of utility revenue, write-off risk, customer perception, and political sensitivity.

* * * * *